US006508528B2

(12) United States Patent
Fujii et al.

(10) Patent No.: US 6,508,528 B2
(45) **Date of Patent: *Jan. 21, 2003**

(54) INK JET PRINTER, CONTROL METHOD FOR THE SAME, AND DATA STORAGE MEDIUM FOR RECORDING THE CONTROL METHOD

(75) Inventors: Masahiro Fujii, Shiojiri; Tsutomu Yamazaki, Suwa, both of (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/522,288

(22) Filed: Mar. 9, 2000

(65) Prior Publication Data

US 2002/0149634 A1 Oct. 17, 2002

(30) Foreign Application Priority Data

Mar. 10, 1999 (JP) ..... 11-063530

(51) Int. Cl.[7] ..... B41J 29/38; B41J 2/045

(52) U.S. Cl. ..... 347/9; 347/10; 347/68

(58) Field of Search ..... 347/9, 10, 11, 347/29, 30, 35, 68, 22, 23, 37

(56) References Cited

U.S. PATENT DOCUMENTS

| | | | | |
|---|---|---|---|---|
| 4,492,968 A | * | 1/1985 | Lee et al. | 347/10 |
| 5,329,293 A | | 7/1994 | Liker | 347/11 |
| 5,493,319 A | | 2/1996 | Hirabayashi et al. | 347/29 |
| 5,847,726 A | | 12/1998 | Hori | 347/23 |
| 6,106,098 A | | 8/2000 | Nakamura et al. | 347/30 |

FOREIGN PATENT DOCUMENTS

| | | | |
|---|---|---|---|
| EP | 0 803 359 A2 | 10/1997 | B41J/2/045 |
| EP | 0 829 354 | 3/1998 | B41J/2/045 |
| GB | 2 272 185 | 5/1994 | B41J/2/165 |
| JP | 56-024875 | 3/1981 | H04N/1/22 |
| JP | 56-129177 | 10/1981 | B41J/3/04 |
| JP | 58-167170 | 10/1983 | B41J/3/04 |
| JP | 60-002368 | 1/1985 | B41J/3/04 |
| JP | 61-59911 | 3/1986 | H03K/17/687 |
| JP | 63-249660 | 10/1988 | B41J/3/04 |
| JP | 2-51734 | 2/1990 | G06F/9/22 |
| JP | 6-39163 | 2/1994 | D05B/21/100 |
| JP | 7-81088 | 3/1995 | B41J/2/175 |
| JP | 9-30007 | 2/1997 | B41J/2/175 |

* cited by examiner

*Primary Examiner*—John Barlow
*Assistant Examiner*—Alfred E Dudding

(57) ABSTRACT

A control method for an ink jet printer capable of a non-discharge nozzle driving operation for stimulating and vibrating an ink meniscus in each ink nozzle of the ink jet head to prevent nozzle clogging does not lead to a drop in print speed. An ink jet head 30 is moved on a carriage 302. Prior to printing on a printing medium (block B2), this non-discharge driving operation (block B31) is performed while the carriage 302 is moving the ink jet head to the print position. Printing is therefore not delayed by the non-discharge driving operation, and nozzle clogging can be prevented without lowering the print speed.

26 Claims, 10 Drawing Sheets

| Statc | [1] | [2] | [3] |
|---|---|---|---|
| Timing pulse Tp | H | L | H |
| Data signal Dx | H | H / L | L |
| Common electrode 22 | V1 | GND | V1 |
| Segment electrode 10x | GND | GND | V2 |
| Diaphragm displacement | 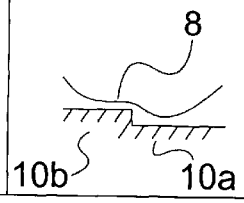  | 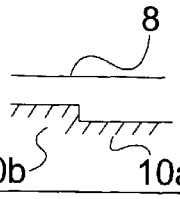  | 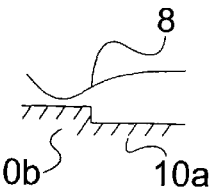  |
FIG. 8

Fig. 9

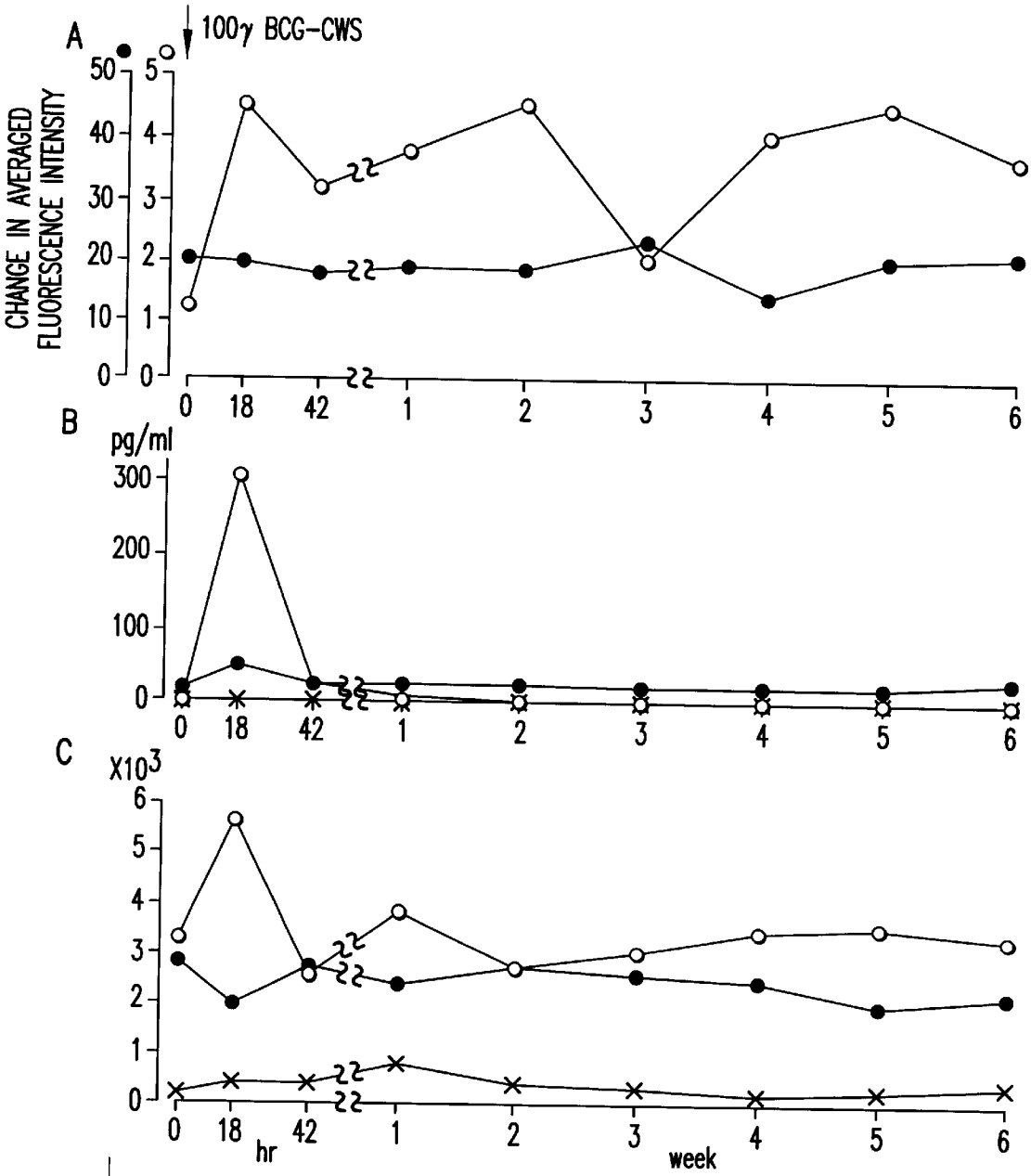

↓ : 100γ of BCG-CWS was inoculated intradermally, and each biological index was determined before and, 18hr, 42hr, 1wk, 2wk, 3wk, 4wk, 5wk and 6wk after inoculation A: Change in averaged fluorescence intensity of a marker on the surface of lymphocytes; CD28(○) and CD46 (●)

B: cytokine level in peripheral blood; IFN-γ (○), G-CSF (●) and IL-12 (×)

C: white cell count in peripheral blood; granulocyte (○), lymphocyte (●) and monocyte (×)

INK JET PRINTER, CONTROL METHOD FOR THE SAME, AND DATA STORAGE MEDIUM FOR RECORDING THE CONTROL METHOD

BACKGROUND OF THE INVENTION

1. Field of the Invention

The present invention relates to an ink jet printer for printing text, symbols, and images by ejecting ink drops from a plurality of ink nozzles to a printing medium. More specifically, the present invention relates to an ink jet printer control method for efficiently preventing ink clogging of the ink nozzles.

2. Description of the Related Art

Various methods have been proposed and used for ejecting ink from the ink nozzles of an ink jet printer. These include: using a piezoelectric element as taught in Japanese Examined Patent Application (kokoku) 2-51734; using a heating element to heat the ink as taught in Japanese Examined Patent Application (kokoku) 61-59911; and using an electrostatic actuator to vibrate a diaphragm by means of electrostatic force as taught in Japanese Unexamined Patent Application (kokai) 7-81088.

Generally speaking, an ink jet printer generates print data in memory from a print data (image) signal, and then selectively drives the pressure generating device or actuator, such as the piezoelectric element, heating element, or electrostatic actuator, adjacent to the ink nozzles based on the print data in memory to print to the printing medium.

A problem common to each of these ink jet printers is that if the ink drops are not ejected from the ink nozzles for a certain amount of time, the water or other solvent in the ink evaporates. This increases the viscosity of ink near the ink nozzles.

When ink viscosity rises near an ink nozzle, the ink nozzle clogs. This prevents ink ejection during printing, or prevents ink drops from being ejected at the normal speed or volume. The ink nozzles are also refilled with ink more slowly when the ink viscosity rises. Ink refilling is thus unable to keep up with ink ejection, bubbles become mixed with the ink, and ink drops may not be ejected as needed.

A common technique used to prevent this in modern ink jet printers is to cover the ink nozzles with a cap when not printing. This prevents the ink nozzles from drying and thus prevents an increase in ink viscosity near the ink nozzles.

Other methods have also been developed to maintain and restore printer performance by preventively ejecting a small volume of ink from all of the ink nozzles at regular intervals between printing operations as a means of preventing ink clogging near the nozzles.

Japanese Examined Patent Application (kokoku) 6-39163 teaches a recovery method wherein the frequency used to drive the ink jet head for preventive ink ejection is set lower than the highest drive frequency used for printing text and images. When ink viscosity has increased in the ink nozzles, this makes it possible to reliably expel high viscosity ink from the ink nozzles without pulling bubbles from the ink nozzles into the ink path.

Yet another method for preventing ink nozzle clogging as a result of dried ink near the ink nozzles is taught in Japanese Unexamined Patent Application (kokai) 56-129177 and 9-30007. This non-discharging nozzle recovery method prevents clogging by using a signal generator to produce a resonance frequency in the ink jet head when printing is not in progress as a means of stimulating and vibrating the ink meniscus, thereby preventing nozzle clogging as a result of ink drying.

Some of the problems unresolved by the above-noted clogging prevention methods are described below.

First, when the ink meniscus is vibrated without ejecting ink drops from the nozzle in the above non-discharging method, the process must be performed when the ink jet head is stopped. This means that if this recovery method is performed frequently during printing, printing must be interrupted each time and printing speed therefore drops.

Furthermore, this non-discharging method does not expel the increased-viscosity ink from the ink nozzles. This means that over a period of time the viscosity of ink increases not only around the ink nozzle orifice but inside the ink supply path upstream from the ink nozzles, and the problem of ink nozzle clogging by increased-viscosity ink is not solved. Therefore, this non-discharging recovery method may not be effective as a means of reliably solving the problem of ink jet head clogging after the printer has been stopped for a long period of time.

On the other hand, while methods that discharge increased-viscosity ink from the ink nozzles physically expel the ink from the nozzles as part of the preventive discharge recovery process, ink that has not increased in viscosity is also expelled at same time. The problem here is the unnecessary consumption of ink not used for actual printing.

Second, even when the time interval between the preventive ink ejection and the actual start of printing is short it may still be sufficient for a film to form on the nozzles. This is the more likely to happen, as the distance between the preventive ink ejection position and the print start position increases. Such film prevents ink droplets from being ejected at normal speed and/or volume.

Third, in the prior art employing the non-discharging method, varying voltages are applied simultaneously to first and second nozzles during normal printing. The first nozzles are those that, in accordance with the print data, eject a droplet onto the printing medium. The second nozzles are those that, in accordance with the print data, do not eject droplets, but are driven so as to vibrate the ink meniscus without ejecting ink droplets. The necessity of applying varying voltages (not including 0 V) at the same time to a head driver requires a complicated circuit structure.

OBJECTS OF THE INVENTION

Therefore, it is an object of the present invention to overcome the aforementioned problems.

It is therefore an object of our invention to provide an ink jet printer control method whereby non-discharge driving the ink jet head nozzles can be accomplished without incurring a drop in printing speed.

A further object of our invention is to provide an ink jet printer control method whereby unnecessary ink consumption can be suppressed, and ink nozzle clogging can be reliably resolved regardless of how long the printer has been stopped.

SUMMARY OF THE INVENTION

To achieve the above object, an ink jet printer control method according to our invention accomplishes a non-discharge driving operation while the ink jet head is being moved relative to the printing medium by a carriage or other moving mechanism prior to printing. The ink jet printer has an ink jet head with a plurality of ink nozzles for discharging ink drops, a pressure generating device or actuator disposed corresponding to said ink nozzles for pressurizing ink inside each ink nozzle, and a moving mechanism for moving the ink jet head relative to the printing medium. This non-discharge driving operation is accomplished by the pressure generating device or actuator micro-vibrating an ink meniscus at each ink nozzle.

With the control method of our invention the non-discharge driving operation is accomplished prior to the start of actual printing while the ink jet head is moving to the printing position. It is therefore not necessary to delay the printing operation, and ink nozzle clogging can be prevented by this non-discharge driving operation without incurring a drop in printing speed.

When the ink jet head is stopped without printing for a long time, it is desirable to use a preventive discharge operation to discharge ink drops not used for printing as a means of reliably avoiding ink nozzle clogging when printing resumes. However, constantly performing this preventive discharge operation is not desirable because of the increase in unnecessary ink consumption.

It is therefore desirable to measure a time (Tk) elapsed since the last non-discharge driving operation, a time (Tf) elapsed since the last preventive discharging operation, and then selectively perform either one of the non-discharge driving operation and preventive discharge operation based on these times Tk and Tf.

In a typical ink jet printer a time (Tt) in a non-printing state in which printing does not occur is also monitored and the ink nozzles are capped when elapsed time Tt is more than or equal to a specific period.

Yet further preferably in this case a time (KJ) elapsed with the ink nozzles capped is also monitored. A head cleaning operation for pulling ink from the ink nozzles is then performed when at a start of printing time KJ is more than or equal to a specific period. If time KJ is less than this specific period, the preventive discharge operation is performed.

A further control method according to our invention is for an ink jet printer having an ink jet head with a plurality of ink nozzles for discharging ink drops, and a pressure generating device or actuator disposed corresponding to said ink nozzles for pressurizing ink inside each ink nozzle. The pressure generating device or actuator accomplishes a non-discharge driving operation by micro-vibrating an ink meniscus at each ink nozzle, and a preventive discharge operation for discharging an ink drop with no relation to a printing operation from each ink nozzle. This control method monitors a time (Tk) elapsed since a non-discharge driving operation, a time (Tf) elapsed since a preventive discharging operation, and prior to printing performs either one of a non-discharge driving operation and preventive discharge operation based on times Tk and Tf.

In this case two elapsed times are used so that when the printer was stopped without printing for a short time the non-discharge driving operation is performed, but if the non-printing time was long, the preventive discharge operation is performed. It is therefore possible to reliably prevent nozzle clogging regardless of how long the printer did not print. Unnecessary consumption of ink not used for printing can therefore be suppressed because preventive discharging is not used when non-discharge driving is sufficient to resolve ink nozzle clogging.

In a typical ink jet printer a time (Tt) in a non-printing state in which printing does not occur is monitored. In this case the ink nozzles are capped when elapsed time Tt is more than or equal to a specific period.

It is further preferable in this case to also monitor time (KJ) elapsed with the ink nozzles capped. When at a start of printing time KJ is more than or equal to a specific period, head cleaning for drawing ink from the ink nozzles is performed, but if time KJ is less than this specific period preventive discharging is preferably used to prevent nozzle clogging.

The control method of the present invention can also be provided as a control program executable by a printer controller, and can be provided by a data storage medium on which the control program is recorded. Storage media and devices that can be used for this data storage medium of the invention include: memory, Compact Discs, particularly CD-ROM media; floppy disks; hard disks; magneto-optical disks; DVD media such as DVD-ROM discs; and magnetic tape. Furthermore, these media can be used to supply this control program to existing printers. Yet further, the program can be made available on a World Wide Web (WWW) site from which users can download the program for use with an existing printer.

Other objects and attainments together with a fuller understanding of the invention will become apparent and appreciated by referring to the. following description and claims taken in conjunction with the accompanying drawings.

BRIEF DESCRIPTION OF THE DRAWINGS

In the drawings, wherein like reference symbols refer to like parts:

FIG. 8 is a logic chart showing the relationship between driver input and output signals in FIG. 7;

FIG. 9 is a timing chart of the printing process used to describe driving the ink jet printer shown in FIG. 1.

DESCRIPTION OF THE PREFERRED EMBODIMENTS

A preferred embodiment of an ink jet printer according to the present invention is described below with reference to the accompanying figures.

Figure 1:
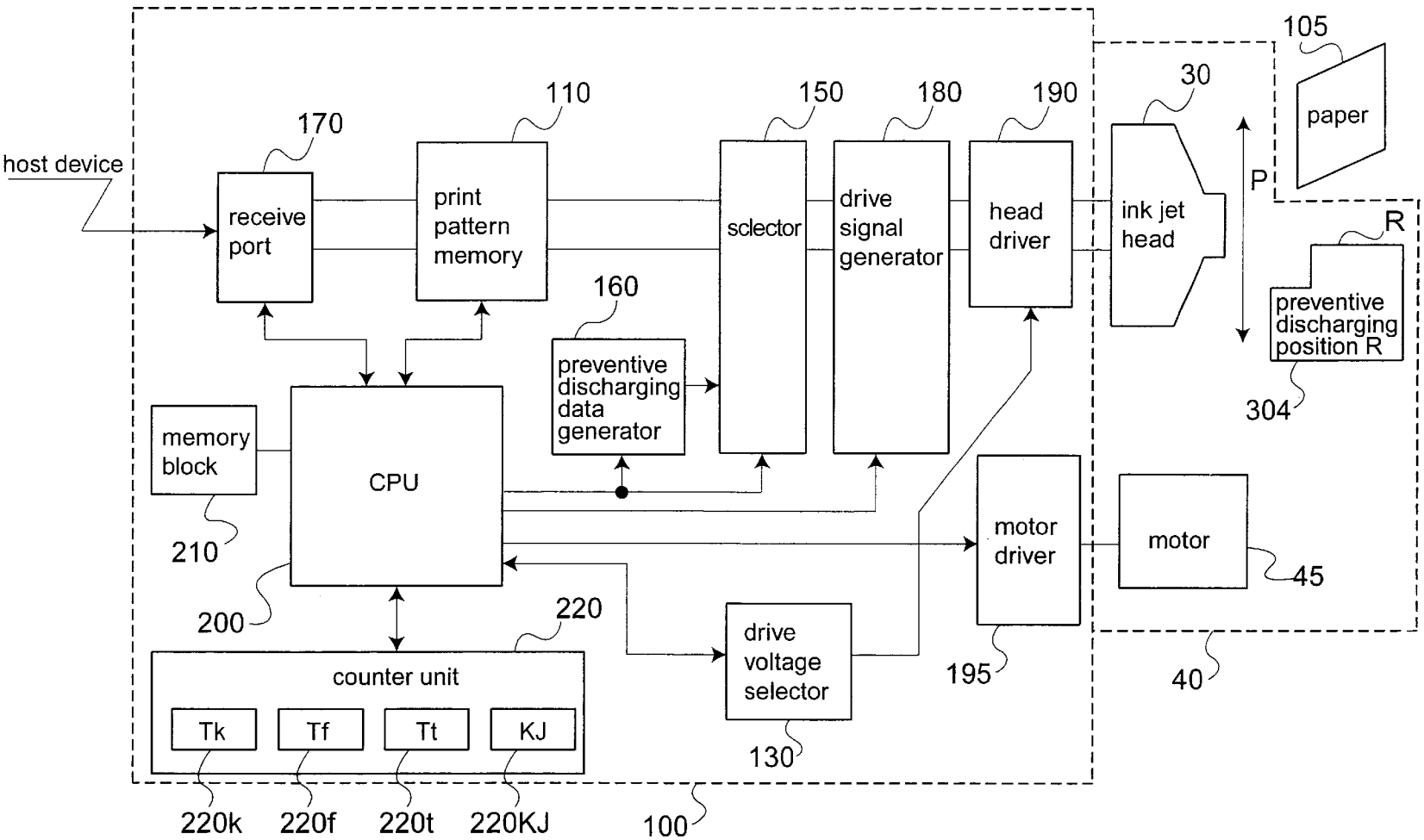
FIG. 1 is a block diagram of an ink jet printer according to a preferred embodiment of the present invention.
Figure 2:
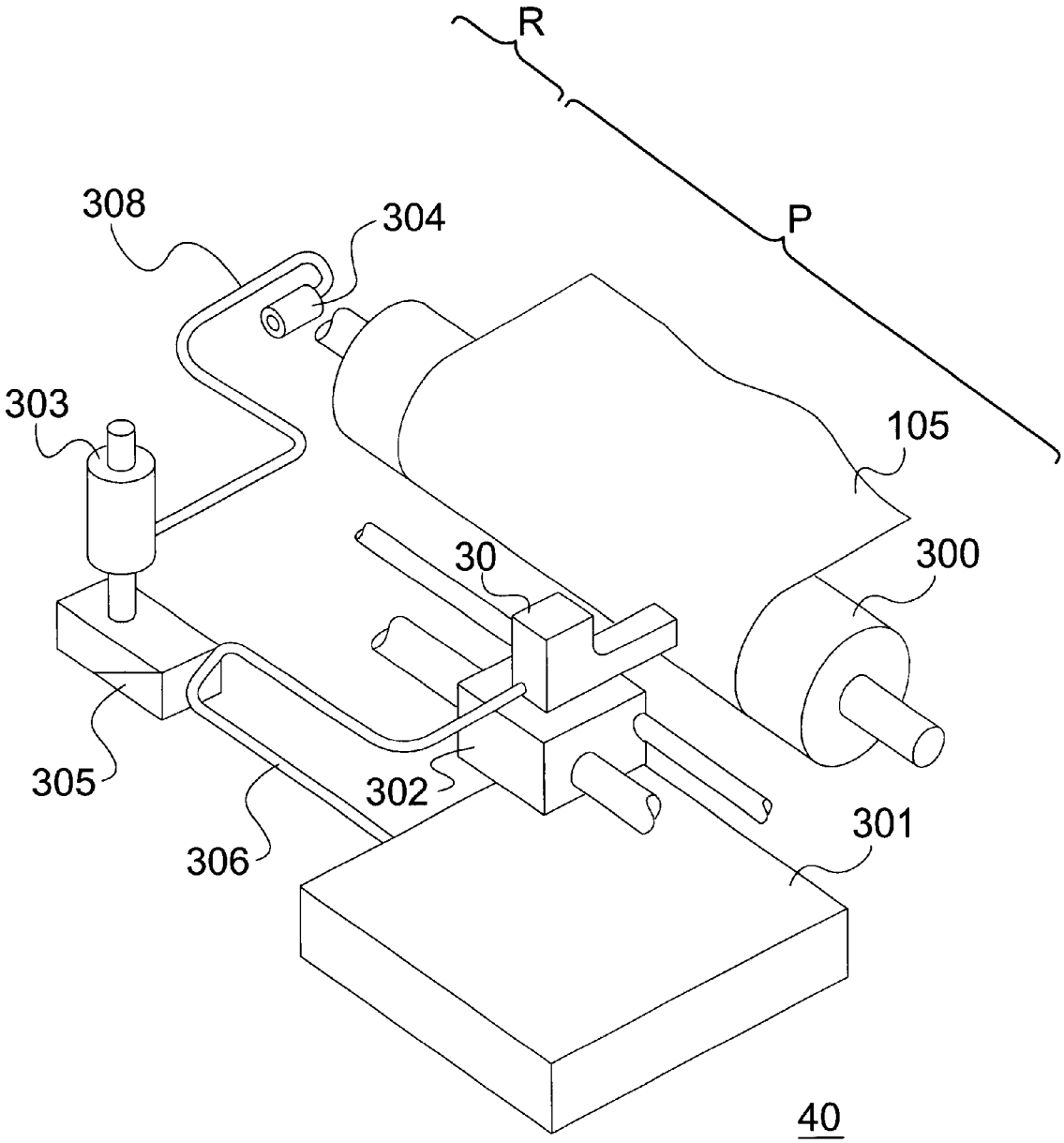
FIG. 2 is a perspective view of the printing unit 40 shown in FIG. 1.

FIG. 1 is a block diagram of an exemplary ink jet printer according to the present invention, and FIG. 2 is a perspective view of the printing unit 40 shown in FIG. 1. As shown in FIG. 1, an ink jet printer according to this preferred embodiment comprises a printing unit 40 and a control unit 100 for controlling the printing unit 40 based on an image signal sent from a host device.

The printing unit 40 is described next below with reference to FIG. 2. The printing medium 105, referred to as simply paper below, is transported by a platen 300. Ink is stored in an ink tank 301 for supply to the ink jet head 30 by way of ink supply tube 306. The ink jet head 30 comprising a pressure generating device or actuator such as a piezoelectric element, heating element, or electrostatic actuator is mounted to a carriage 302. The carriage 302 is driven by a motor 45 (see FIG. 1), and is arranged to travel in a direction perpendicular to the feed direction of paper 105.

Pump 303 can be used to draw ink from inside the ink jet head 30 by way of cap 304 and waste ink recovery tube 308 for recovery into a waste ink reservoir 305. The recovery process using pump 303 is applied to the ink jet head when recovery by the preventive discharging process described further below can no longer restore ink jet head function, such as when nothing has been printed for a long period of time, or there is a bubble in an ink nozzle.

The ink jet head 30 mounted on carriage 302 travels between the printing range P, the width of which is approximately equal to the platen 300 width, and a preventive discharging position R in front of cap 304. Ink drops are ejected from the ink nozzles in this printing range P to print. Ink drops are ejected at the preventive discharging position R to prevent nozzle orifice clogging.

The cap 304 can move forward and backward, i.e., advance toward and retract from ink jet head 30. To absorb ink from inside the ink jet head 30, the cap 304 moves forward to cover the ink nozzles of the ink jet head 30. For preventive discharging after standby the cap 304 may be in its forward position and cover the ink nozzles. For preventive discharging in between printing, however, the cap 304 may stay in its backward position. In both cases of preventive discharging ink droplets are ejected from all nozzles into the cap 304.

This preventive discharging position R is also typically used as the home position of the carriage 302. When the power is turned on, the ink jet head is positioned at the preventive discharging position R with the ink nozzles covered by the cap 304 until a print command is received.

The receive port 170 shown in FIG. 1 is a serial or parallel communications port for receiving print data and control signals from a host device. Image data contained in such signal received via the receive port 170 is stored to a print pattern memory 110, which is typically implemented as a certain area of a RAM. Data at an address in the RAM that is specified by the printer operation control unit (CPU) 200 can be sequentially output to a selector 150 using an appropriate address signal and read/write signal.

The preventive discharging data generator 160 generates data for preventive discharging operations. This data causes ink to be ejected from all ink nozzle orifices. The preventive discharging data generator 160 outputs to the selector 150.

The selector 150 selects output from the print pattern memory 110 or the preventive discharging data generator 160 for supply to the drive signal generator 180.

The drive signal generator 180 generates drive data signals D1 to Dn for corresponding ink nozzles N1 to Nn based on the data from the selector 150, and timing pulses Tp from the CPU. The pulse widths and the timing of the drive signals that are applied to a head driver 190 are, thus, determined by the timing pulses Tp The head driver 190 is for stepping up the level of the drive signals from drive signal generator 180 for application to the actuators in the ink jet head 30. Motor driver 195 is for driving the motor 45 based on a control signal output from CPU 200. The control signal is synchronized with the timing pulses Tp in the sense that the period of the timing pulses corresponds to the dot spacing on the paper.

Memory block 210 comprises RAM for storing, for example, print commands contained in the signals received from the host device, and ROM for storing a control program for controlling various components of the control unit 100. The CPU 200 appropriately controls the above-noted circuits and functional components based on the control program.

The timer or other counter unit 220 according to the present invention comprises a first counter **220*k* for measuring the time Tk since the last non-discharge driving operation, further described below; a second counter 220*f* for measuring the time Tf since the last preventive discharging operation; a third counter 220*t* for measuring the non-printing time (idle time) Tt, i.e., how long the printer is stopped without printing; and a fourth counter 220KJ for measuring the print pause time (capping time) KJ that the ink jet head was capped by cap 304**. When the time monitored by each of these counters passes, the corresponding counter outputs a count-up signal instructing the start of a non-discharge drive operation or preventive discharging operation, or sets a flag to announce that a specific time has elapsed.

The drive voltage selector 130 applies, based on a control signal from the CPU 200, either a first (V1) or a second voltage (V2) to the head driver 190 as will be explained in more detail later.

Ink Jet Head

Figure 3:
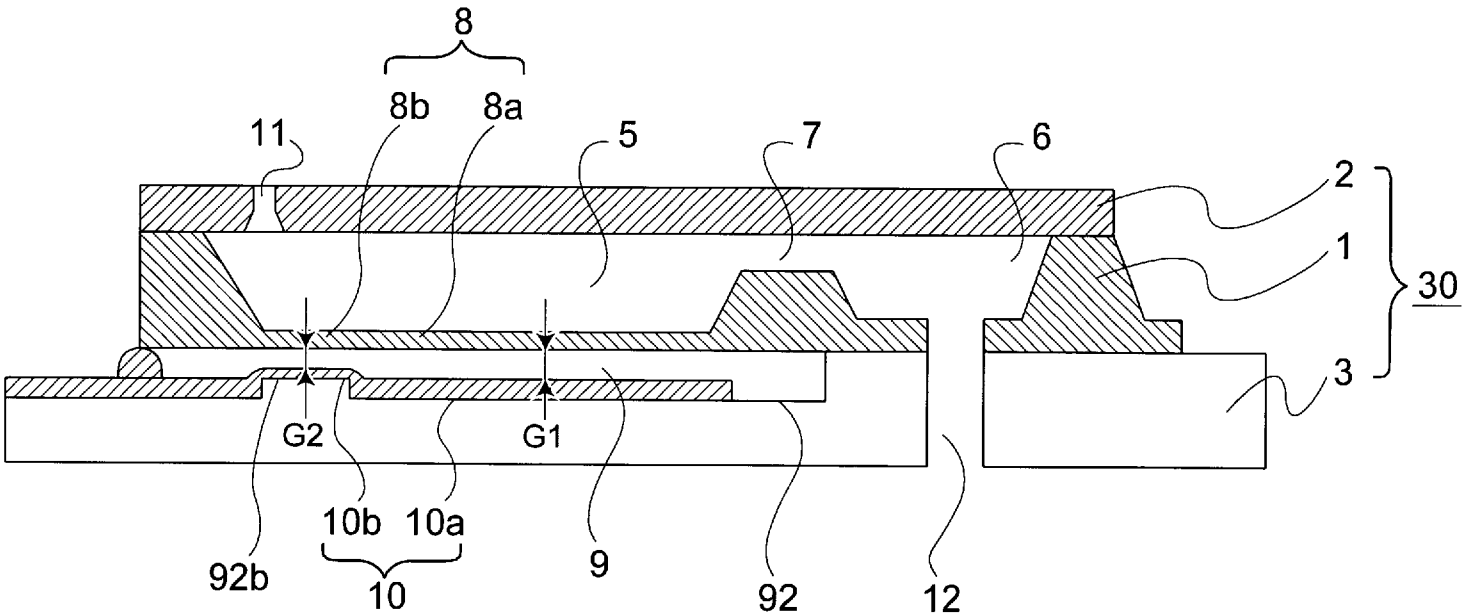
FIG. 3 is a section view of a typical ink jet head 30 shown in FIG. 1.
Figure 4:
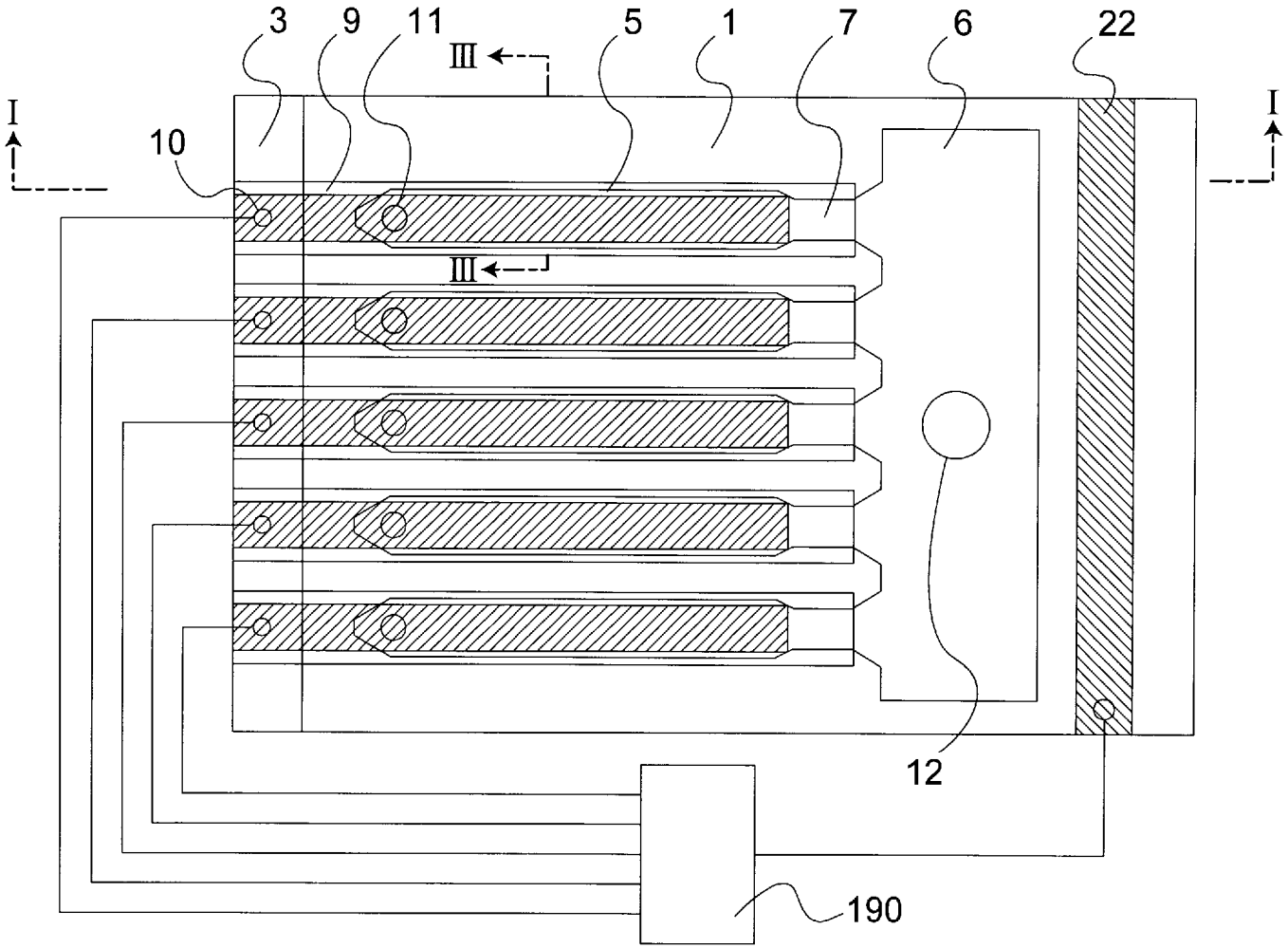
FIG. 4 is a plan view of the ink jet head 30 shown in FIG. 3.
Figure 5A:
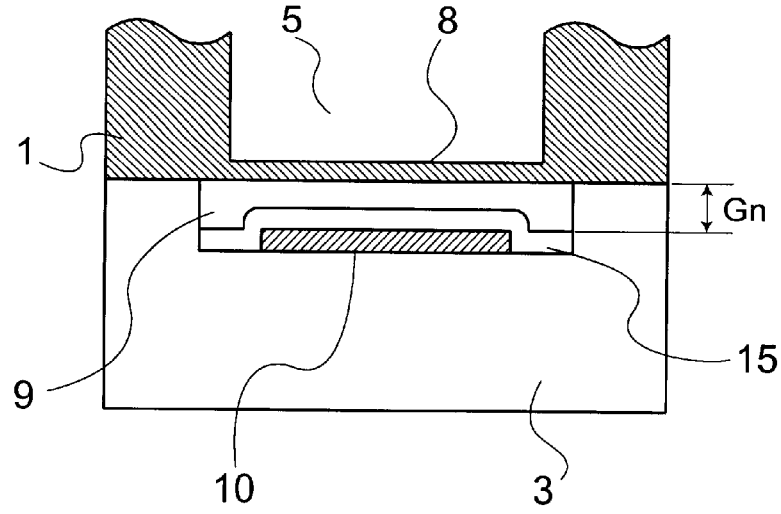
FIG. 5 is a typical section view of the ink jet head 30 shown in FIG. 3, FIG. 5A showing the standby state, FIG. 5B the ink charging state, and FIG. 5C ink compression.

FIG. 3 is a typical section view of an ink jet head 30 according to this preferred embodiment of the invention, FIG. 4 is a plan view of the same, and FIG. 5 is a partial section of the same.

As shown in these figures, ink jet head 30 is a three layer structure comprising a silicon substrate 1 disposed between a silicon nozzle plate 2 thereabove and a borosilicate glass plate 3 therebelow. It should be noted that the thermal expansion coefficient of the borosilicate glass plate 3 is substantially equal to that of silicon.

Channels (Recesses) functioning as a plurality of mutually independent ink chambers 5, a common ink chamber 6 shared by the independent ink chambers 5, and an ink supply path 7 connecting the common ink chamber 6 to each of the independent ink chambers 5, are etched into a surface of the middle silicon substrate 1, or more specifically into the top surface thereof as seen in the figures. These channels (i.e., the surface of silicon substrate 1) are covered by the nozzle plate 2, thereby separating and forming parts 5, 6, and 7.

An ink nozzle 11 is formed in the nozzle plate 2 at a position near the end of each ink chamber 5. Each ink nozzle 11 is open to the corresponding ink chamber 5. An ink supply opening 12 communicating with the common ink chamber 6 is also formed in the nozzle plate 2. Ink can thus be supplied from the ink tank 301 (see FIG. 2) through ink supply opening 12 by way of ink supply tube 306 (see again FIG. 2) to the common ink chamber 6. Ink supplied to the common ink chamber 6 is then supplied to the independent ink chambers 5 through the corresponding ink supply path 7.

Each ink chamber 5 is formed with a thin bottom wall 8. This bottom wall 8 functions as a diaphragm that is flexibly displaceable up and down as viewed in FIG. 3. This bottom wall 8 is therefore also synonymously referred to below as diaphragm 8 in the following description.

A shallow etched recess 9 is formed in the top surface of the glass plate 3 contacting the bottom surface of silicon substrate 1, that is, in the surface thereof that bonds to silicon substrate 1, at a position corresponding to each ink chamber 5 in the silicon substrate 1. The bottom wall 8 of ink chamber 5 therefore opposes surface 92 of recess 9 in glass plate 3 across a very slight gap. A protrusion 92*b* projecting from surface 92 towards bottom wall 8 is formed in the ink nozzle 11 side surface of the recess 9. The part of bottom wall 8 opposite protrusion 92*b* is referred to as bottom 8*b* below. The gap between bottom 8*b* and protrusion 92*b* is smaller than the gap between the rest of surface 92 and the rest of bottom wall 8, referred to as bottom part 8*a* below.

It should be noted that bottom wall 8 of each ink chamber 5 functions as an electrode for charge accumulation. A segment electrode 10 is formed on each recess surface 92 in glass plate 3 opposite bottom wall 8 of each ink chamber 5. The surface of each segment electrode 10 is covered with an insulation layer 15 (see FIG. 5) of thickness G0. The insulation layer 15 is an inorganic glass. It will thus be obvious that each segment electrode 10 and corresponding ink chamber bottom wall 8 form opposing electrodes with the insulation layer 15 therebetween and a different electrode gap in parts. More specifically, the distance between these opposing electrodes is G2 near the nozzle, and G1 in other areas.

As shown in FIG. 4, the head driver 190 for driving the ink jet head charges and discharges these opposing electrodes based on a drive signal output from drive signal generator 180 and a control signal output from CPU 200. One output from the head driver 190 is connected directly to each segment electrode 10, and the other output is connected to a common electrode terminal 22 formed on silicon substrate 1. Impurities are injected to the silicon substrate 1, which is therefore conductive. It is therefore possible to supply a charge from the common electrode terminal 22 to bottom wall 8. To reduce the contact resistance between the silicon substrate 1 and the common electrode, a thin film of gold or other conductive material can be formed by vapor deposition, sputtering, or other technique onto a surface of the silicon substrate 1. In this exemplary embodiment the silicon substrate 1 and glass plate 3 are coupled by anodic bonding, and a conductive film is therefore formed on the side of the silicon substrate 1 in which the flow channel (ink path) is formed.

Figure 5B:
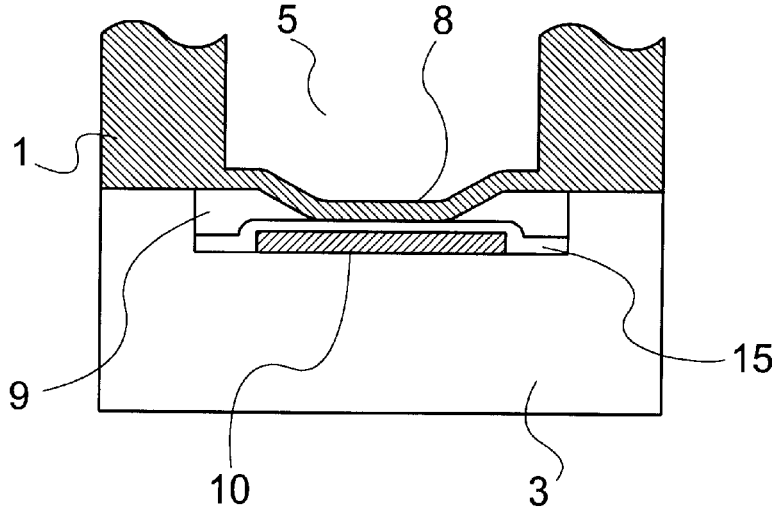
Figure 5C:
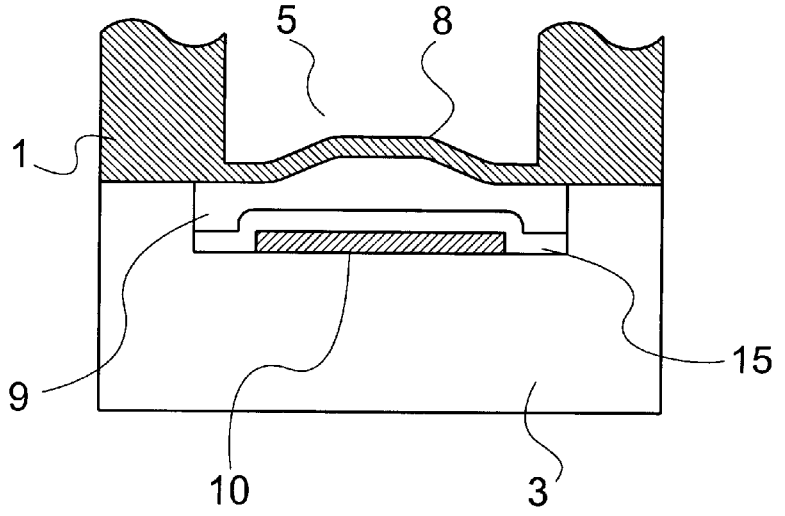

FIG. 5 is a section view through line III—III in FIG. 4. When a drive voltage is applied to opposing electrodes from head driver 190, the Coulomb force produced therebetween causes bottom wall (diaphragm) 8 to deflect towards segment electrode 10, thereby increasing the capacity of the ink chamber 5 (see FIG. 5B). When the charge between the opposing electrodes is then rapidly discharged by the head driver 190, the diaphragm 8 returns as a result of the inherent elastic restoring force of the diaphragm, and suddenly reduces the capacity of the ink chamber 5 (see FIG. 5C). The pressure thus generated inside the ink chamber 5 causes part of the ink filling the ink chamber 5 to be discharged as an ink drop from the ink nozzle 11 linked to that ink chamber 5.

As shown in FIG. 3, however, there is both a small gap G2 and a large gap G1 between opposing electrodes. Compared with the other bottom part 8*a*, the bottom 8*b* of diaphragm 8 disposed to small gap G2 can be easily attracted to the protrusion 92*b* by applying a smaller drive voltage.

It is therefore possible to achieve two diaphragm vibration modes depending upon whether a high drive voltage causing all of the diaphragm to deflect towards the surface 92, or a drive voltage only high enough to deflect bottom 8*b* of diaphragm 8, is applied. More specifically, a vibration mode in which diaphragm 8 vibrates greatly to discharge an ink drop, and a vibration mode in which diaphragm 8 vibrates only in part so as to move the ink near the ink nozzle (that is, micro-vibrates the ink meniscus), can be achieved by applying the appropriate drive voltage.

Drive Circuit

Figure 6:
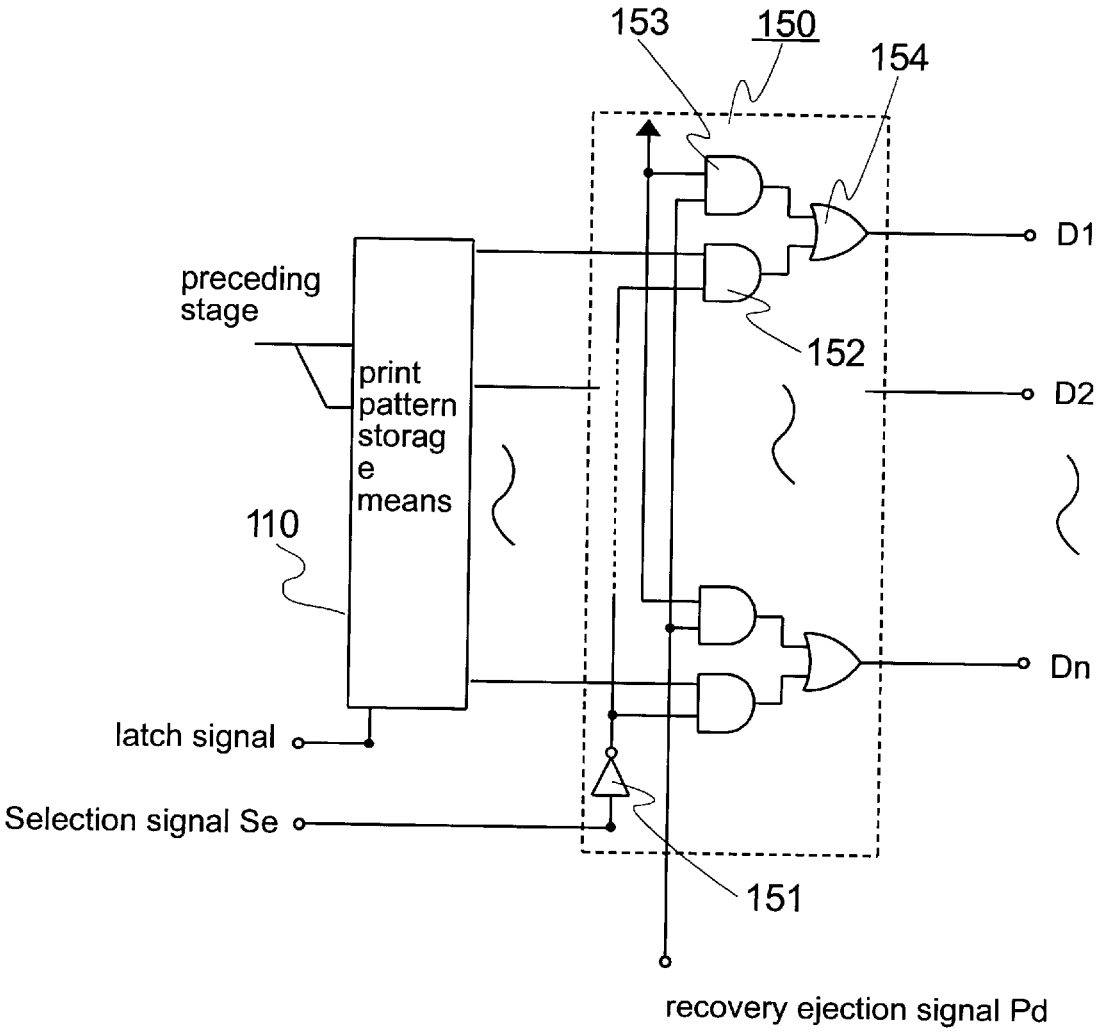
FIG. 6 is a circuit diagram of one example of the selector 150 shown in FIG. 1.
Figure 7:
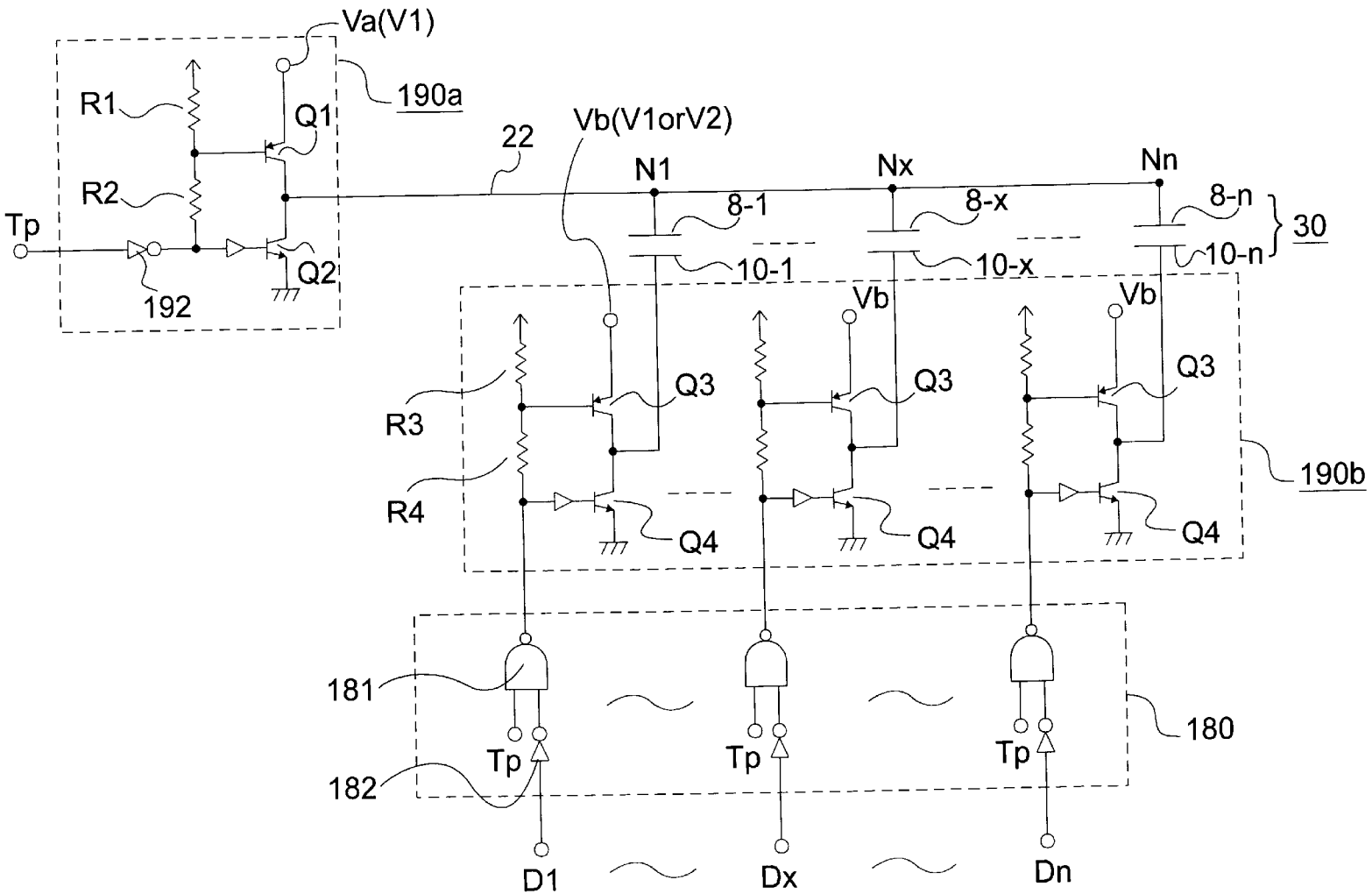
FIG. 7 is a circuit diagram of one example of the head driver 190 shown in FIG. 1.

An example of a drive circuit that is preferably employed is described next with reference to FIGS. 6 to 8. FIG. 6 is a circuit diagram showing an exemplary selector 150 (see FIG. 1). FIG. 7 is a circuit diagram of the major components of a head driver 190 comprising a drive voltage selector 130.

Shown in FIGS. 6 to 8 are receive buffer 110, which functions as the print pattern memory 110 in FIG. 1; selector 150; and drive pulse generator 180 for applying an appropriate drive signal to each ink nozzle N1 to Nn according to the drive data signals D1 to Dn output from selector 150. It should be noted that receive buffer (print pattern memory) 110, selector 150, and drive signal generator 180 can be integrated to a single device using a gate array.

The receive buffer 110 stores one vertical column of print data, outputting data to the next stage (selector 150) and fetching data from the preceding stage (receive port 170) in response to a latch signal applied from the CPU 200. The column of print data corresponds to one or more lines of nozzles arrayed in or substantially in the direction of paper transport.

As shown in FIG. 6, the selector 150 comprises two AND gates 152, 153 and one OR gate 154 for each one nozzle. Depending upon the state of a selection signal Se supplied from CPU 200, the selector 150 selects either print data output from the receive buffer 110, or preventive discharge data generated by the preventive discharging data generator 160, and outputs to the drive pulse generator 180.

When selection signal Se is low, NOT gate 151 outputs high, causing one input to AND gate 152 to go high. As a result, the print data from receive buffer 110 supplied to the other input of AND gate 152 is passed directly to the drive signal generator 180. However, if selection signal Se is high, the preventive discharge data is output to the drive pulse generator 180 instead of the print data from receive buffer 110. As a result, the data causing an ink drop to be discharged from all nozzles may be periodically supplied to the drive signal generator 180.

Referring to FIG. 7, drive signal generator 180 has a number of stages equal to the number of n segment electrodes 10 (=number of ink nozzles). Each stage comprises a NAND gate 181 and a NOT gate 182. A timing pulse Tp of a specific pulse width is applied to one input terminal of each NAND gate 181. The drive data signals D1 to Dn output from the selector 150 are each inverted by the respective NOT gate 182 and then applied to the other input terminal of the respective NAND gate 181.

The head driver 190 comprises a common electrode driver 190*a* for applying a voltage to the common electrode terminal 22 (and thus the diaphragms 8), and a segment electrode driver 190*b* for applying drive voltages to each segment electrode 10 based on the drive data signals D1 to Dn. The common electrode driver 190*a* can switch the voltage supplied to the common electrode terminal 22 between a first voltage V1 and the ground (0 V); the segment electrode driver 190*b* can switch the voltage supplied to the segment electrode 10 between the first voltage V1, a second voltage V2, and the ground (0 V). (V1 is applied to terminal Va, V1 or V2 is selectively applied to terminal Vb.)

It should be noted that V1 is greater than V2, and a voltage of either V1 or V1−V2 can be applied between opposing electrodes (between diaphragm 8 and segment electrode 10). Including 0 V, three different voltages can thus be applied to the opposing electrodes.

The common electrode driver 190*a* comprises primarily transistors Q1 and Q2, and resistors R1 and R2. The timing pulse Tp is applied to the input terminal of the common electrode driver 190*a*. When timing pulse Tp becomes on (high), transistor Q1 turns on and voltage V1 is applied to the common electrode terminal 22. When the timing pulse Tp goes off (low), transistor Q1 goes off and transistor Q2 goes on, thus connecting common electrode terminal 22 to ground (0 V).

The segment electrode driver 190*b* has circuits comprising primarily transistors Q3 and Q4 and resistors R3 and R4 in a number equal to the number (n) of segment electrodes 10. Each input terminal of the segment electrode driver 190*b* is connected to an output terminal of the drive signal generator 180. The emitters of transistors Q3 are connected to a terminal Vb to which the voltage selector 130 applies either the first voltage V1 or the second voltage V2. During normal printing, That is, when, in accordance with the print data, some ink nozzles are to eject ink droplets and others not, the first voltage V1 is applied to terminal Vb. For the non-discharging process, however, the second voltage V2 is applied to terminal Vb.

Considering by way of example the X-th nozzle 11*x*, when data Dx for ink nozzle 11*x* is high so that the ink nozzle 11*x* is to discharge ink, transistor Q4 turns on and the corresponding segment electrode 10*x* goes to ground.

When data Dx for ink nozzle 11*x* is low, that is, ink nozzle 11*x* is not to discharge ink, transistor Q3 goes on and voltage V2 is applied to the corresponding segment electrode 10*x* when the timing pulse Tp goes on (high).

The table in FIG. 8 shows the relationship between timing pulse Tp, data signal Dx, and the potential between opposing electrodes. When timing pulse Tp and data signal Dx are both high, the potential difference between opposing electrodes is V1, the electrode gap is charged, and all of diaphragm 8 deflects toward the segment electrode (state 1). When the timing pulse Tp goes low from state 1, the opposing electrodes go to the same potential, the accumulated charge is discharged, the diaphragm 8 returns to the original position, and an ink drop is discharged from the corresponding ink nozzle 11 by the pressure thus generated in the ink chamber 5 (state 2).

When timing pulse Tp is high and data signal Dx is low, the potential difference between the opposing electrodes is V1−V2. The diaphragm 8 is therefore deflected to the segment electrode 10 only at the protruding part 10*b* thereof (state 3). When the timing pulse Tp goes low from state 3, the opposing electrodes go to the same potential, the accumulated charge is discharged, and the diaphragm 8 returns to the original position. The amplitude of the diaphragm 8 at this time, however, is smaller than that produced by the change from state 1 to state 2. As a result, the pressure generated in the ink chamber 5 is not sufficient to discharge an ink drop from the ink nozzle 11, and vibration of diaphragm 8 results therefore in mobilizing ink around the nozzle 11.

FIG. 8 illustrates the same where the voltage selector 130 applies the second voltage V2 to terminal Vb. As mentioned before, V2 is applied only for effecting the non-discharging process. During printing, however, the first voltage V1 is applied to terminal Vb. As will be appreciated by those skilled in the art, in this case 0V is applied to the opposing electrodes both in state [2] and in state[3] because the voltage applied in state [3] is V1−V1.

The operation of the above circuits is further described below with reference to the timing chart in FIG. 9.

The selection signal Se output from the CPU 200 is set to low in order to print. The column printing data read into receive buffer 110 is then passed to the drive signal generator 180 in response to a latch signal 120 output from the CPU 200. This selection signal Se remains low while printing continues. As a result, the column printing data continues to be passed to the drive signal generator 180 and output to the head driver 190.

As shown in FIG. 9, timing pulse Tp asserted to drivers 190*a* and 190*b* is a periodic pulse of period T and pulse width Pw. The time from the start of charging the opposing electrodes to the start of discharging is determined by pulse width Pw.

Motor 45 for moving the carriage 302 is driven synchronized to this timing pulse Tp. The latch signal applied to the receive port 170 is also synchronized to the timing pulse Tp.

Data signal Dx input to the drive pulse generator 180 is output high synchronized to the timing pulse Tp at the position at which an ink drop is to be discharged based on the print data. As shown in the figure, if the first dot is printed and the second and third dots are not printed, data signal Dx is output high, low, low. Note that in FIG. 9 row (2), the trapezoidal pulses denoted Dx only represent the width of the data in the drive signal sequence, not the logical level. The logical level is indicated by the symbol "●" representing high and "○" representing low.

When the potential of terminal Vb of segment electrode driver 190*b* is set to V2 and this data signal Dx sequence is output, drive pulses of pulse width Pw and amplitude of V1, V1−V2, V1−V2 are applied to the opposing electrodes. That is, an ink drop is discharged at dot 1, but at dots 2 and 3 an ink drop is not discharged and ink near the nozzle is simply fluidly moved. To apply only a pulse of amplitude V1 to the opposing electrodes, the potential of terminal Vb of driver 190*b* can remain V1.

Using a circuit as described above, a low amplitude drive pulse can be applied to fluidly move ink near an ink nozzle, and thereby prevent an increase in ink viscosity near the ink nozzle, using a simple circuit configuration and without requiring complex control. It is therefore possible to prevent a rise in ink viscosity at infrequently used nozzles. That is, a difference in viscosity at nozzle orifices in the same ink jet head resulting from a difference in the frequency of use can be reduced, the interval between preventive discharging operations can be increased, and unnecessary consumption of ink for these preventive discharging operations can be reduced.

This method is particularly effective with color ink jet printers comprising a plurality of ink nozzles for each of the colors of ink used because it is particularly easy for a difference in the frequency of nozzle use to occur in such ink jet heads.

The latch signal 120 output from the CPU 200 is stopped, and any printing process is interrupted when a preventive discharging operation is to be performed. The ink jet head 30 is then moved to the preventive discharging position R, the selection signal Se goes high, preventive discharging data causing all nozzles to discharge ink is supplied to the drive signal generator 180, and all nozzles are thus driven to discharge a certain number of droplets. The number of droplets to be ejected can be determined, case by case, in accordance with the times KJ and Tf. This helps keeping the ink consumption for the preventive discharging operation as low as possible.

By holding all data signals low as the ink jet head 30 moves to the preventive discharging position R and applying timing pulse Tp, a low amplitude drive pulse for moving ink near the nozzles can be applied to suppress an increase in ink viscosity near the ink nozzles.

It should be noted that the drive circuit in this exemplary embodiment is described driving an ink jet head having an electrostatic actuator as the pressure generating device or actuator. It will be obvious, however, that the same effect can be achieved using this type of circuit to drive an ink jet head using a piezoelectric element, or an ink jet head using a heating element, as the pressure generating device or actuator.

Displacement of a piezoelectric element can be varied by controlling the voltage of the applied drive pulse. It is therefore possible in this case to stimulate movement of ink near the nozzle while not causing ink to discharge. The heat generated by a heating element can be similarly controlled by the voltage of the applied drive pulse, and it is again possible to stimulate movement of ink near the nozzle to a level that will not cause ink to discharge by using a low amplitude drive pulse.

Furthermore, the electrostatic actuator of the present embodiment has a step (G1, G2) in the gap between opposing electrodes in the embodiment described above. It will also be obvious, however, that a vibration mode for discharging ink drops, and a vibration mode for stimulating movement of ink near the ink nozzles, can be achieved without such a step in the electrode gap by appropriately controlling the pulse width and voltage of the drive pulse applied to the opposing electrodes.

Yet further, it will also be obvious that the drive circuit described in this preferred embodiment can be applied to a serial or line type ink jet head.

Control Description

Figure 10:
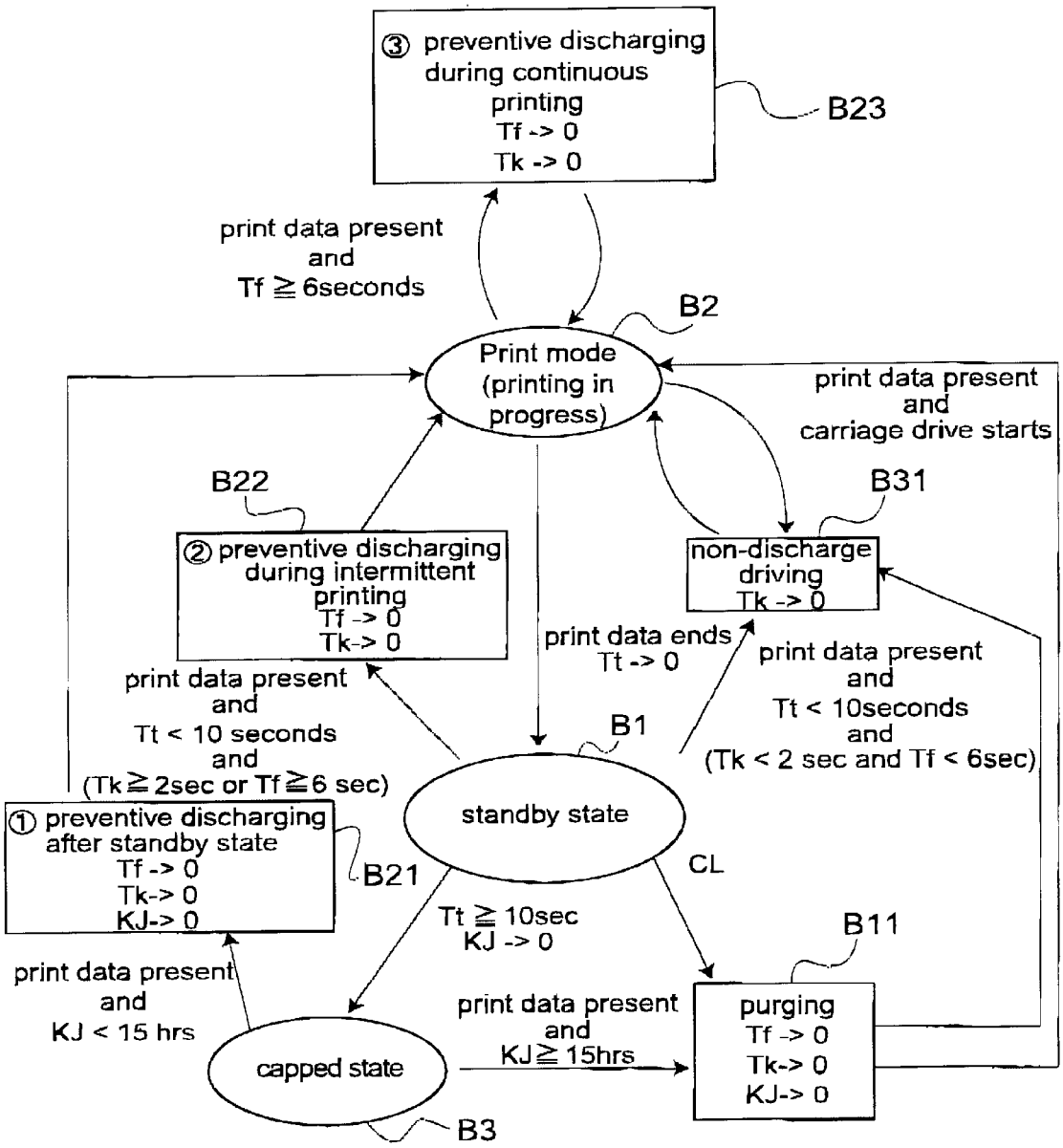
FIG. 10 is a state transition diagram for an ink jet printer according to the present invention.

FIG. 10 is a state transition diagram used to describe an ink jet printer control method according to this preferred embodiment of the invention. Drive control by this control method is described next below with reference to FIG. 10.

It should be noted that the initialization process performed when the printer is turned on to initialize the control unit 100 and the printing unit 40 are identical to those of a common ink jet printer. Following such initialization a head recovery (purging) process is performed for purging from the ink nozzles ink that has increased in viscosity while the printer was not in use. This process suctions ink from the ink nozzles using pump 303.

While the ink jet printer is operable (power is on) it can be in any one of the following three basic states: a standby state B1, a printing state B2,and a capped state B3 (the capped state differs from the standby state B1 in that the nozzle 11 of the ink jet head are covered with the cap 304 and in that, in the standby state, the ink jet head need not necessarily be in the home position). In addition to these basic states there are the following transitional states: the recovery (purging) process (block B11), the preventive discharging process blocks B21, B22 and B23), and the non-discharging process (block B31).

At least one of the purging process (block B11), preventive discharging processes (blocks B21 to B23), and non-discharging,process (block B31) is performed in response to each print command, that is, when there is data to be printed; which of the three recovery processes, purging, preventive discharging and/or non-discharging, is performed in response to a print command depends on the values of the counters 220KJ, 220*f*, 220*t*, and 220*k* in the counter unit 220. As mentioned before, the first counter 220*k* counts the time Tk since the last non-discharge driving operation (block B31); the second counter 220*f* counts the time Tf since the last preventive discharging operation (blocks B21 to B23); the third counter 220*t* counts the idle time Tt during which the printer is not printing (block B1); and the fourth counter 220KJ counts the capping time KJ, i.e., the time during which the ink jet head is capped (block B3).

(1) Operation when the ink jet printer is in the printing stopped state B1 is described first.

Whenever the printer enters the standby state B1 counter 220*t* is reset to count the idle time Tt. If the printer stays in the standby state B1 for an idle time of Tt 10 seconds or longer, there is a state transition to the capped state B3, i.e.,the ink jet head 30 is capped. The printer remains in the capped state until it receives a print command. If a print command is received while the printer is in this capped state B3; the next control state is determined according to the duration of the capped state (capping time KJ).

If capping time KJ is less than 15 hours, preventive discharge process is executed as represented by block B21. This preventive discharge operation removes ink that has increased in viscosity while the printer was in the standby state B1 or the capped state B3, and ink nozzle clogging at the resumption of printing is avoided. Counters 220KJ, 220*k*, and 220*f* are reset after the preventive discharge operation. The printer then transits to the printing state B2, i.e., the ink jet head 30 is uncapped and moved to the print start position by means of carriage 302, whereupon the print data is printed.

If the capping time KJ is more than or equal to 15 hours, purging is performed as represented by block B11, and then the printer transits to the printing state B2. Purging removes ink that has increased in viscosity and any bubbles. Counters 220KJ, 220*k*, and 220*f* are reset after purging. It is to be noted that the non-discharge operation (block B31) can be performed after purging and before the printer moves to the printing state B2. In this case, it is possible to improve the quality of printing. Experiments have shown that the non-discharge operation prior to printing ensures ink droplets, especially for the first dot, being ejected at the normal speed or volume which may not be the case otherwise.

When the printer is in the standby mode B1 it can be forced by a command CL to perform purging as indicated in FIG. 10.

(2) Operation when the ink jet printer is in the printing mode B2 is described next.

As printing continues, second counter 220*f* measures the time Tf elapsed since the last preventive discharge operation, and preventive discharge operation is performed every 6 seconds, i.e. each time the second counter 220*f* has counted Tf=6 seconds. Counters 220*f* and 220*t* are then reset, and printing continues. By interrupting continuous printing operations for preventive discharge operation in this manner, clogging can be prevented in infrequently used ink nozzles.

It should be noted that while the carriage 302 is moving the ink jet head 30 from the home position R to the printing position after this preventive discharge operation to resume printing, and while the carriage is moving the ink jet head 30 during such continuous printing from one position to another one with no printing in between, the non-discharge driving operation (block B31) is performed. This non-discharge driving operation prevents formation of a film on the ink in each ink nozzle, and can thus prevent ink nozzle clogging. Since this non-discharge operation is performed while the ink jet head is not printing and is being moved to the next printing position it does not cause any drop in printing speed. In addition, such non-discharge operation allows the period of the flushing to be longer (6 s in this example) than it would have to be otherwise.

(3) Intermittent printing means there is a pauses (standby state B1) of less than 10 seconds in between successive printing operations. In this case, whether preventive discharge operation (block B22), or non-discharge operation (block B31) is performed depends on times Tf and Tk.

That is, if a print command or print data is received when the printing stopped state B1 is entered after block B2 because the printing operation for one sequence of print data ended, either non-discharge driving operation B31 or preventive discharge process B22 is performed to prevent ink nozzle clogging based on time Tk since the last non-discharge operation, and time Tf since the last preventive discharge operation.

(3-1) If time Tk since the last non-discharge process is less than 2 seconds, and time Tf since the last preventive discharge operation is less than 6 seconds, the non-discharge driving operation B31 is performed. More specifically, a low amplitude (V1–V2) drive pulse is applied as described above to stimulate and vibrate the ink meniscus, thereby preventing a film forming over the increased-viscosity ink in each nozzle, and thus avoiding nozzle clogging. After this non-discharge operation is finished, counter 220*k* is reset and the printing state B2 entered.

It should be noted that the carriage 302 (with ink jet head 30 mounted on it) is waiting at the home position R or inside the printing range P2 during the standby state B1, and is moved from the home position to the actual printing position. According to this preferred embodiment of the invention, the non-discharge process is accomplished during this carriage movement before printing starts. Therefore the non-discharge operation does not lead to a drop in printing speed. All ink nozzles are driven during this non-discharge operation while the ink jet head is being moved.

(3-2) If time Tk since the last non-discharge process is 2 seconds or more, or time Tf since the last preventive discharge operation is 6 seconds or more, a preventive discharge process B22 is performed and counters 220*f* and 220*k* are reset before the printer enters the printing state B2 again. In this case it is assumed that nozzle clogging cannot be reliably avoided by means of the non-discharge driving.

According to this preferred embodiment, a non-discharge driving process is employed when there is only a short printing pause (less than 2 seconds); otherwise nozzle clogging is prevented by means of a preventive discharge operation. Unnecessary consumption of ink not used for actual printing is therefore less than in the case where a preventive discharge operation is always performed before printing is resumed, and, yet, ink nozzle clogging can be reliably avoided.

As described above, an ink jet printer control method according to the present invention applies to an ink jet printer having an ink jet head with a plurality of ink nozzles for discharging ink drops, a pressure generating device or actuator disposed corresponding to said ink nozzles for pressurizing ink inside each ink nozzle and driving each ink nozzle to stimulate and vibrate the ink meniscus at each ink nozzle without discharging ink, and a means for moving the ink jet head relative to the printing medium. The control method of our invention accomplishes non-discharge driving of the ink jet head while the ink jet head is being moved prior to printing to the printing medium.

It should be noted that with the control method of our invention the non-discharge driving operation is accomplished prior to the start of printing while the ink jet head is moving to the printing position. It is therefore not necessary to delay the printing operation for the non-discharge driving operation, and ink nozzle clogging can be prevented by this operation without incurring a drop in printing speed.

Our invention further provides a control method for an ink jet printer having an ink jet head with a plurality of ink nozzles for discharging ink drops, and a pressure generating device or actuator disposed corresponding to said ink nozzles for pressurizing ink inside each ink nozzle. In this ink jet printer the pressure generating device or actuator can be driven in a non-discharge driving operation to stimulate and vibrate the ink meniscus at each ink nozzle, and a preventive discharge operation to discharge an ink drop with no relation to a printing operation from each ink nozzle. The control method in this case monitors a time Tk since the last non-discharge driving operation, and a time Tf since the last preventive discharging operation. Before starting to print, either the non-discharge driving operation or preventive discharge operation is performed based on times Tk and Tf.

Using these two times Tk and Tf, this exemplary control method selects and performs a non-discharge driving operation when the printer is stopped without printing for a short time, and selects and performs a preventive discharge operation when the printer is stopped for a longer time.

Ink nozzle clogging can therefore be reliably prevented regardless of how long printing has been stopped. At the same time, nozzle clogging is prevented using the non-discharge driving operation when this operation is sufficient, and therefore does not discharge ink. As a result, unnecessary consumption of ink not contributing to actual printing can be suppressed.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A control method for an ink jet printer that includes an ink jet head having a plurality of ink nozzles for discharging ink drops, each ink nozzle including an ink meniscus, the ink jet head further including a pressure generating actuator for pressurizing ink inside each ink nozzle, said control method comprising the steps of:

measuring a first time representing the time elapsed since a non-discharge driving operation was last performed;

measuring a second time representing the time elapsed since a preventive discharging operation was last performed; and selectively performing one of:

micro-vibrating the ink meniscus in each ink nozzle by means of the pressure generating actuator to perform a non-discharge driving operation while the ink jet head is moved relative to a printing medium prior to a printing operation, if the first time is less than a first predetermined value and the second time is less than a second predetermined value, or discharging an ink drop from each ink nozzle by means of the pressure generating actuator with no relation to a printing operation, if the first time is greater than or equal to the first predetermined value or the second time is greater than or equal to the second predetermined value.

2. The control method of claim 1, further comprising the steps of:

measuring a third time representing the time during which the printer is in a non-printing state; and capping the ink nozzles when the third time is greater than or equal to a third predetermined value.

3. The control method of claim 2, further comprising the steps of:

measuring a fourth time representing the time elapsed since the ink nozzles were last capped;

suctioning ink from the ink nozzles when, at a start of printing, the fourth time is greater than or equal to a fourth predetermined value; and discharging an ink drop from each ink nozzle by means of the pressure generating actuator when the fourth time is less than the fourth predetermined value.

4. A control method for an ink jet printer that includes an ink jet head having a plurality of ink nozzles for discharging ink drops, each ink nozzle including an ink meniscus, the ink jet head further including a pressure generating actuator for pressurizing ink inside each ink nozzle, said control method comprising the steps of:

measuring a first time representing the time elapsed since a non-discharge driving operation was last performed;

measuring a second time representing the time elapsed since a preventive discharging operation was last performed;

measuring a third time representing the time during which the printer is not printing;

measuring a fourth time representing the time elapsed since the ink nozzles were last capped; and transitioning into one of a plurality of states including a standby state, a capped state, a non-discharge driving operation state and a preventive discharging operation state based on the measured first, second, third and fourth times.

5. The control method of claim 4, wherein the printer transitions into at least one of the non-discharge driving operation state and the preventive discharging operation state in response to a print command received by the printer.

6. The control method of claim 5, wherein, from the standby state, the printer transitions into the non-discharge driving operation state if the first time is less than a first predetermined value, the second time is less than a second predetermined value, a print command is received, and the third time is less than the third predetermined value;

the preventive discharging operation state if the first time is greater than or equal to the first predetermined value or the second time is greater than or equal to the second predetermined value, a print command is received, and the third time is less than the third predetermined value; and the capped state if the third time is greater than or equal to a third predetermined value.

7. An ink jet printer comprising an ink jet head having a plurality of ink nozzles for discharging ink drops, each ink nozzle including an ink meniscus, the ink jet head further including a pressure generating actuator for pressurizing ink inside each ink nozzle, and a storage medium for storing a control program for implementing the method of any one of claims 1–6.

8. An ink jet printer, comprising:

an ink jet head having a plurality of ink nozzles for discharging ink drops, each ink nozzle including an ink meniscus;

a pressure generating actuator that pressurizes ink inside each ink nozzle;

a transportation mechanism that moves the ink jet head relative to a printing medium;

at least one counter that measures a first time representing the time elapsed since a non-discharge driving operation was last performed and that measures a second time representing the time elapsed since a preventive discharging operation was last performed;

a non-discharge driver that micro-vibrates the ink meniscus in each ink nozzle by means of the pressure generating actuator to perform a non-discharge driving operation while the ink jet head is moved relative to the printing medium prior to a printing operation;

a preventive discharge driver that discharges an ink drop from each ink nozzle by means of the pressure generating actuator with no relation to a printing operation; and a controller that selects and operates the non-discharge driver if the first time is less than a first predetermined value and the second time is less than a second predetermined value, and that selects and operates the preventive discharge driver if the first time is greater than or equal to the first predetermined value or the second time is greater than or equal to the second predetermined value.

9. The ink jet printer of claim 8, wherein the at least one counter measures a third time representing the time during which the printer is in a non-printing state and a fourth time representing the time elapsed since the ink nozzles were last capped, the ink jet printer further comprising:

a cap that covers the ink nozzles of the ink jet head when the third time is greater than or equal to a third predetermined value; and a pump that suctions ink from the ink nozzles when, at a start of printing, the fourth time is greater than or equal to the third predetermined value.

10. A device-readable data storage medium embodying a program instructions executable by such a device to perform a method of controlling an ink jet printer that includes an ink jet head having a plurality of ink nozzles for discharging ink drops, each ink nozzle including an ink meniscus, the ink jet head further including a pressure generating actuator for pressurizing ink inside each ink nozzle, said program of instructions comprising instructions for:

measuring a first time representing the time elapsed since a non-discharge driving operation was last performed;

measuring a second time representing the time elapsed since a preventive discharging operation was last performed; and selectively performing one of:

micro-vibrating the ink meniscus in each ink nozzle by means of the pressure generating actuator to perform a non-discharge driving operation while the ink jet head is moved relative to a printing medium prior to a printing operation, if the first time is less than a first predetermined value and the second time is less than a second predetermined value, or discharging an ink drop from each ink nozzle by means of the pressure generating actuator with no relation to a printing operation, if the first time is greater than or equal to the first predetermined value or the second time is greater than or equal to the second predetermined value.

11. The device-readable data storage medium of claim 10, further comprising instructions for:

measuring a third time representing the time during which the printer is in a non-printing state; and capping the ink nozzles when the third time is greater than or equal to a third predetermined value.

12. The device-readable data storage medium of claim 11, further comprising instructions for:

measuring a fourth time representing the time elapsed since the ink nozzles were last capped;

suctioning ink from the ink nozzles when, at a start of printing, the fourth time is greater than or equal to a fourth predetermined value; and discharging an ink drop from each ink nozzle by means of the pressure generating actuator when the fourth time is less than the fourth predetermined value.

13. A device-readable data storage medium embodying a program instructions executable by such a device to perform a method of controlling an ink jet printer that includes an ink jet head having a plurality of ink nozzles for discharging ink drops, each ink nozzle including an ink meniscus, the ink jet head further including a pressure generating actuator for pressurizing ink inside each ink nozzle, said program of instructions comprising instructions for:

measuring a first time representing the time elapsed since a non-discharge driving operation was last performed;

measuring a second time representing the time elapsed since a preventive discharging operation was last performed;

measuring a third time representing the time during which the printer is not printing;

measuring a fourth time representing the time elapsed since the ink nozzles were last capped; and transitioning into one of a plurality of states including a standby state, a capped state, a non-discharge driving operation state and a preventive discharging operation state based on the measured first, second, third and fourth times.

14. The device-readable data storage medium of claim 13, wherein the printer transitions into at least one of the non-discharge driving operation state and the preventive discharging operation state in response to a print command received by the printer.

15. The device-readable data storage medium of claim 14, wherein, from the standby state, the printer transitions into the non-discharge driving operation state if the first time is less than a first predetermined value, the second time is less than a second predetermined value, a print command is received, and the third time is less than the third predetermined value;

the preventive discharging operation state if the first time is greater than or equal to the first predetermined value or the second time is greater than or equal to the second predetermined value, a print command is received, and the third time is less than the third predetermined value; and the capped state if the third time is greater than or equal to a third predetermined value.

16. An ink jet printer, comprising:

an ink jet head having a plurality of ink nozzles;

a plurality of pressure generating actuators, each associated with a respective one of the ink nozzles;

first drive means for selectively driving the actuators so as to apply pressure to the ink of a respective nozzle sufficient to eject an ink droplet from that nozzle;

second drive means for driving the actuators so as to apply pressure to the ink of a respective nozzle sufficient to move the ink without causing ink to be discharged from that nozzle;

a transportation mechanism for causing movement of the ink jet head relative to a printing medium; and a controller, responsive to a print command, for causing the transportation mechanism to move the ink jet head into a print start position relative to the printing medium and, subsequently, to activate the first drive means in order to perform a printing operation by ejecting ink droplets onto the printing medium, wherein the controller is adapted to activate the second drive means to drive all actuators during the relative movement to the print start position and while the ink jet head is not printing.

17. An ink jet printer, comprising:

an ink jet head having a plurality of ink nozzles;

a plurality of pressure generating actuators, each associated with a respective one of the ink nozzles;

first drive means for selectively driving the actuators so as to apply pressure to the ink of a respective nozzle sufficient to eject an ink droplet from that nozzle;

second drive means for driving the actuators so as to apply pressure to the ink of a respective nozzle sufficient to move the ink without causing ink to be discharged from that nozzle;

a transportation mechanism for causing movement of the ink jet head relative to a printing medium;

a controller, responsive to a print command, for causing the transportation mechanism to move the ink jet head into a print start position relative to the printing medium and, subsequently, to activate the first drive means in order to perform a printing operation by ejecting ink droplets onto the printing medium, wherein the controller is adapted to activate the second drive means to drive all actuators during the relative movement to the print start position;

third drive means adapted to be activated by the controller for driving all of the actuators to apply pressure to the ink in the respective nozzles and eject ink droplets from the nozzles for flushing the ink jet head;

a first counter for measuring a first time representing the time elapsed since a most recent activation of the third drive means; and a second counter for measuring a second time representing the time elapsed since a most recent activation of the second drive means;

wherein the controller is adapted to activate, in response to a print command, either the second or the third drive means depending on the first and second times.

18. The ink jet printer, comprising:

an ink jet head having a plurality of ink nozzles;

a plurality of pressure generating actuators, each associated with a respective one of the ink nozzles;

first drive means for selectively driving the actuators so as to apply pressure to the ink of a respective nozzle sufficient to eject an ink droplet from that nozzle;

second drive means for driving the actuators so as to apply pressure to the ink of a respective nozzle sufficient to move the ink without causing ink to be discharged from that nozzle;

a transportation mechanism for causing movement of the ink jet head relative to a printing medium;

a controller, responsive to a print command, for causing the transportation mechanism to move the ink jet head into a print start position relative to the printing medium and, subsequently, to activate the first drive means in order to perform a printing operation;

third drive means adapted to be activated by the controller for driving all of the actuators to apply pressure to the ink in the respective nozzles sufficient to eject ink droplets from the nozzles for flushing the ink jet head;

a first counter for measuring a first time representing the time elapsed since a most recent activation of the third drive means; and a second counter for measuring a second time representing the time elapsed since a most recent activation of the second drive means;

wherein the controller is adapted to activate, in response to a print command, either the second or the third drive means depending on the first and second times.

19. The ink jet printer of claim 7 or 18; further comprising:

a cap for covering the nozzles of the ink jet head; and a third counter for measuring a third time representing the continuous time during which the first drive means remains inactive;

wherein the controller is adapted to cause the nozzles to be capped with the cap when the third time is greater than or equal to a first predetermined value.

20. The ink jet printer of claim 19, further comprising:

a pump for sucking ink from the nozzles for purging the nozzles; and a fourth counter for measuring a fourth time representing the continuous time during which the nozzles remain capped;

wherein the controller is responsive to the print command to activate, prior to moving the ink jet head to the print start position, the pump when the fourth time is greater than or equal to a second predetermined value, the third drive means when the fourth time is less than the second predetermined value.

21. A method of controlling an ink jet printer that includes an ink jet head having a plurality of ink nozzles, a plurality of pressure generating actuators, each associated with a respective one of the ink nozzles, and a transportation mechanism for causing movement of the ink jet head relative to a printing medium, said method comprising the steps of:

(a) detecting a print command;

(b) controlling, in response to step (a), the transportation mechanism so as to move the ink jet head relative to a printing medium into a print start position;

(c) executing, following step (b), the print command by selectively driving the actuators so as to eject ink droplets from respective nozzles onto the printing medium; and (d) driving the actuators in the ink jet head so as to move the ink in each nozzle without discharging ink from the nozzles;

wherein step (d) is executed while the ink jet head is being moved in step (b) and while the ink jet head is not printing.

22. A method of controlling an ink jet printer that includes an ink jet head having a plurality of ink nozzles, a plurality of pressure generating actuators, each associated with a respective one of the ink nozzles, and a transportation mechanism for causing movement of the ink jet head relative to a printing medium, said method comprising the steps of:

(a) detecting a print command;

(b) controlling, in response to step (a), the transportation mechanism so as to move the ink jet head relative to a printing medium into a print start position;

(c) executing, following step (b), the print command by selectively driving the actuators so as to eject ink droplets from respective nozzles onto the printing medium;

(d) driving the actuators in the ink jet head so as to move the ink in each nozzle without discharging ink from the nozzles;

wherein step (d) is executed while the ink jet head is being moved in step (b)

(e) flushing the ink jet head by discharging an ink droplet from each nozzle;

(f) measuring a first time representing the time elapsed since the most recent execution of step (e); and (g) measuring a second time representing the time elapsed since the most recent execution of step (d);

wherein, depending on the first and second times measured in steps (f) and (g), step (e) is performed prior to step (b) or step (d) is performed substantially simultaneously with step (b).

23. A method of controlling an ink jet printer that includes an ink jet head having a plurality of ink nozzles, a plurality of pressure generating actuators, each associated with a respective one of the ink nozzles, and a transportation mechanism for causing movement of the ink jet head relative to a printing medium, said method comprising the steps of:

(a) detecting a print command;

(b) controlling, in response to step (a), the transportation mechanism so as to move the ink jet head relative to a printing medium into a print start position;

(c) executing, following step (b), the print command by selectively driving the actuators so as to eject ink droplets from respective nozzles onto the printing medium; and (d) driving the actuators in the ink jet head so as to move the ink in each nozzle without discharging ink from the nozzles;

(e) flushing the ink jet head by discharging an ink droplet from each nozzle;

(f) measuring a first time representing the time elapsed since the most recent execution of step (e); and (g) measuring a second time representing the time elapsed since the most recent execution of step (d);

wherein, depending on the first and second times measured in steps (f) and (g), step (e) or step (d) is performed in response to a print command.

24. The method of claim 22 or 23, further comprising the steps of:

(h) measuring a third time representing the continuous time during which step (c) is not executed; and (i) covering the nozzles with a cap when the third time is greater than or equal to a first predetermined value.

25. The method of claim 24, further comprising the steps of:

(j) measuring a fourth time representing the continuous time during which the nozzles remain capped;

(k) obtaining the value of the fourth time in response to step (a), and performing step (e) when the value obtained in step (k) is less than a second predetermined value, otherwise purging the nozzles by sucking ink from the nozzles.

26. An ink jet printer, comprising:

an ink jet head having a plurality of ink nozzles;

a plurality of pressure generating actuators, each associated with a respective one of the ink nozzles;

a driver for selectively driving the actuators so as to apply pressure to the ink of a respective nozzle sufficient to eject an ink droplet from that nozzle, and for driving the actuators so as to apply pressure to the ink of a respective nozzle sufficient to move the ink without causing ink to be discharged from that nozzle;

a transportation mechanism for causing movement of the ink jet head relative to a printing medium; and a controller, responsive to a print command, for causing the transportation mechanism to move the ink jet head into a print start position relative to the printing medium and, subsequently, to activate the driver in order to perform a printing operation by ejecting ink droplets onto the printing medium, wherein the controller is adapted to activate the driver to drive all actuators so as to apply pressure to the ink of a respective nozzle sufficient to move the ink without causing ink to be discharged from that nozzle during the relative movement to the print start position and while the ink jet head is not printing.

* * * * *